United States Patent [19]

Trout

[11] Patent Number: 4,859,559

[45] Date of Patent: Aug. 22, 1989

[54] HYDROXYCARBOXYLIC ACIDS AS ADJUVANTS FOR NEGATIVE LIQUID ELECTROSTATIC DEVELOPERS

[75] Inventor: Torence J. Trout, Wilmington, Del.

[73] Assignee: E. I. Du Pont de Nemours and Company, Wilmington, Del.

[21] Appl. No.: 27,612

[22] Filed: Mar. 18, 1987

[51] Int. Cl.[4] ..... G03G 9/12

[52] U.S. Cl. ..... 430/115; 430/904; 430/110; 430/137

[58] Field of Search ..... 430/115, 110, 904, 137

[56] References Cited

U.S. PATENT DOCUMENTS

| | | | |
|---|---|---|---|
| 2,891,911 | 6/1959 | Mayer | 430/114 X |
| 3,528,097 | 9/1970 | Otsuka et al. | 430/115 X |
| 3,826,747 | 7/1974 | Nagashima | 430/110 X |
| 3,856,692 | 12/1974 | Mammino | 430/116 |
| 3,869,397 | 4/1975 | Tellier et al. | 430/115 |
| 3,925,219 | 12/1975 | Strong | 430/111 |
| 3,985,664 | 10/1976 | Sakaguchi | 430/109 |
| 4,062,789 | 12/1977 | Tamai et al. | 430/115 |
| 4,144,184 | 3/1979 | Takahata et al. | 430/115 |
| 4,289,668 | 9/1981 | Li | 524/310 |
| 4,663,264 | 5/1987 | Mitchell | 430/115 |

*Primary Examiner*—J. David Welsh

[57] ABSTRACT

Negative, liquid electrostatic developer consisting essentially of (A) nonpolar liquid having Kauri-butanol value less than 30, present in major amount. '(B) thermoplastic resin particles having a hydroxycarboxylic acid as defined dispersed therein and average particle size by area being less than 10 μm, and (C) nonpolar liquid soluble ionic or zwitterionic compound which imparts a negative charge to the thermoplastic resin particles. Optionally additional adjuvants are present. The liquid electrostatic developer is useful in copying, making proofs including digital color proofs, lithographic printing plates, and resists.

48 Claims, No Drawings

HYDROXYCARBOXYLIC ACIDS AS ADJUVANTS FOR NEGATIVE LIQUID ELECTROSTATIC DEVELOPERS

TECHNICAL FIELD

This invention relates to a negative-working liquid electrostatic developer having improved properties. More particularly this invention relates to a negative-working liquid electrostatic developer containing resin particles having dispersed therein a hydroxycarboxylic acid.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, aluminum stearate, etc., to the liquid toner comprising the thermoplastic resin, dispersant nonpolar liquid, and preferably a colorant. Such liquid developers provide images of good resolution, but it has been found that charging and image quality are particularly pigment dependent. Some formulations, suffer from poor image quality manifested by significant low resolution, poor solid area coverage (density), and/or image squash. Some toners, particularly those having a plurality of fibers integrally extending therefrom, are highly flocculated and settle rapidly in the dispersion. In order to overcome such problems much research effort has been expended to develop new type charge directors and/or charging adjuvants for electrostatic liquid toners or developers.

It has been found that the above disadvantages can be overcome and improved developers prepared containing a dispersant nonpolar liquid, ionic or zwitterionic charge director compound, a thermoplastic resin, and preferably a colorant. The improved negative, liquid electrostatic developer when used to develop an electrostatic image results in improved image quality, reduced squash, improved solid area coverage independent of the pigment and charge director present.

DISCLOSURE OF THE INVENTION

In accordance with this invention there is provided an improved negative, liquid electrostatic developer consisting essentially of (A) a nonpolar liquid having a Kauri-butanol value of less than 30, present in a major amount, (B) thermoplastic resin particles having dispersed therein a hydroxycarboxylic acid of the formula: HO—X—COOH wherein X is a divalent saturated or unsaturated aliphatic hydrocarbon containing at least 12 carbon atoms or aromatic hydrocarbon containing at least 6 carbon atoms, and in which there are at least 4 carbon atoms between the hydroxy and carboxylic acid groups, the resin particles having an average by area particle size of less than 10 μm, and (C) a nonpolar liquid soluble ionic or zwitterionic charge director compound which imparts a negative charge to the thermoplastic resin particles.

In accordance with an embodiment of this invention there is provided a process for preparing a negative liquid electrostatic developer for electrostatic imaging comprising (A) dispersing at an elevated temperature in a vessel a thermoplastic resin, a hydroxycarboxylic acid of the formula: HO—X—COOH wherein X is a divalent saturated or unsaturated aliphatic hydrocarbon containing at least 12 carbon atoms or aromatic hydrocarbon containing at least 6 carbon atoms, and in which there are at least 4 carbon atoms between the hydroxy and carboxylic acid groups, a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid;

(C) separating the dispersion of thermoplastic toner particles having an average by area particle size of less than 10 μm from the particulate media, and (D) adding to the dispersion a nonpolar liquid soluble ionic or zwitterionic charge director compound which imparts a negative charge to the thermoplastic toner particles.

Throughout the specification the below-listed terms have the following meanings:

In the claims appended hereto "consisting essentially of" means the composition of the liquid electrostatic developer does not exclude unspecified components which do not prevent the advantages of the developer from being realized. For example, in addition to the primary components, there can be present additional components, such as fine particle size oxides, adjuvant, e.g., polyhydroxy compound, aminoalcohol, polybutylene succinimide, aromatic hydrocarbon, etc.

Aminoalcohol means that there is both an amino functionality and hydroxyl functionality in one compound.

Squash means the blurred edges of the image.

Beading means that there are large pools of developer in the solid areas of the image and breakage of lines in fine features.

Flow means that large droplets show in the solid areas of the image and there is smearing of fine features.

Conductivity is the conductivity of the developer measured in picomhos (pmho)/cm at 5 hertz and 5 volts and can be referred to as BULK.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| NorPar ® 12 | 69 | 204 |
| NorPar ® 13 | 93 | 210 |
| NorPar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperatures. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax® resins, E. I. du Pont de Nemours and Company, Wilmington, DE), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acetate series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, DE, etc., or blends thereof. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238, Procedure A. Particularly preferred copolymers of this type have an acid number of 66 and 60 and a melt index of 100 and 500 determined at 190° C., respectively.

The thermoplastic resins described above have dispersed therein a hydroxycarboxylic acid of the formula: HO—X—COOH wherein X is a saturated or unsaturated aliphatic hydrocarbon containing at least 12 carbon atoms or aromatic hydrocarbon containing at least 6 carbon atoms, and in which there are at least 4 carbon atoms between the hydroxy and carboxylic acid groups. In the said hydroxycarboxylic acids the radical represented by X preferably contains from 15 to 20 carbon atoms, and it is further preferred that there are between 8 and 14 carbon atoms between the carboxylic acid and the hydroxy groups.

Examples of said hydroxycarboxylic acids include: ricinoleic acid, 10-hydroxystearic acids and mixtures thereof, 12-hydroxystearic acid, and preferably the commercially available hydrogenated castor oil fatty acid which contains in addition to the 12-hydroxystearic acid minor amounts of stearic acid and palmitic acid, 16-hydroxyhexadecanoic acid, 15-hydroxypentadecanoic acid, 12-hydroxydodecanoic acid, 4-hydroxybenzoic acid, 2-hydroxy-1-naphthoic acid, 3-hydroxy-2-naphthoic acid, 1-hydroxy-2-naphthoic acid, 2-hydroxyphenylacetic acid, 3-hydroxyphenylacetic acid, 4-hydroxyphenylacetic acid, and 3-(4-hydroxyphenyl)-propionic acid, etc. The hydroxycarboxylic acid is present in the developer solids in an amount of 0.1 to 10 percent by weight, preferably 1 to 5 percent by weight based on the total weight of the developer solids. The method whereby the hydroxycarboxylic acid is dispersed in the thermoplastic resin is described below.

In addition, the resins have the following preferred characteristics:

1. Be able to disperse the hydroxycarboxylic acid, metal soap, if present, colorant, e.g., pigment,
2. Be insoluble in the dispersant liquid at temperatures below 40° C, so that the thermoplastic resin will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become swollen or gelatinous.

Suitable nonpolar liquid soluble ionic or zwitterionic charge director compounds (C), which are generally used in an amount of 0.25 to 1500 mg/g, preferably 2.5 to 400 mg/g developer solids, include: negative charge directors, e.g., Basic Calcium Petronate®, Basic Barium Petronate® oil-soluble petroleum sulfonate, manufactured by Sonneborn Division of Witco Chemical Corp., New York, NY, etc.

As indicated above, additional components that can be present in the liquid electrostatic developer are colorants, such as pigments or dyes and combinations thereof, are preferably present to render the latent image visible through this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Sterling NS N 774 (Pigment Black 7, C.I. No. 77266).

Other ingredients may be dispersed into the liquid electrostatic developer, such as fine particle size oxides, e.g., silica, alumina, titania, etc.; preferably in the order of 0.5 μm or less can be dispersed into the liquefied resin. These oxides can be used in combination with the colorant. Metal particles can also be added.

Another additional component of the liquid electrostatic developer is an adjuvant which can be taken from the group of polyhydroxy compound which contains at least 2 hydroxy groups, aminoalcohol, polybutylene succinimide, metallic soap, inorganic metal salt, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

POLYHYDROXY COMPOUNDS ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc.

AMINOALCOHOL COMPOUNDS triisopropanolamine, triethanolamine, ethanolamine, 3-amino-1-propanol, o-aminophenol, 5-amino-1-pentanol, tetra(2-hydroxyethyl)ethylenediamine, etc.

POLYBUTYLENE SUCCINIMIDE

OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

METALLIC SOAP aluminum tristearate; aluminum distearate; barium, calcium, lead and zinc stearates; cobalt, manganese, lead and zinc linoleates; aluminum, calcium, and cobalt octoates; calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout, U.S. Application Ser. No. 857,326, filed Apr. 30, 1986 now U.S. Pat. No. 4,707,429, the disclosure of which is incorporated herein by reference.

AROMATIC HYDROCARBON benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc.

INORGANIC METAL SALTS salts wherein the cationic component is selected from the group consisting of metals of Group Ia, Group IIa, and Group IIIa of the periodic table, and wherein the anionic component of said salt is selected from the group consisting of halogen, carbonate, acetate, sulfate, borate, nitrate and phosphate. The inorganic metal salt is dispersed in the thermoplastic resin as described in El-Sayed U.S. application Ser. No. 014710 filed Feb. 12, 1987, entitled "Inorganic Metal Salt as Adjuvant For Negative Liquid Electrostatic Developers," the disclosure of which is incorporated herein by reference.

The particles in the liquid electrostatic developer have an average by area particle size of less than 10 μm, preferably the average by area particle size is less than 5 μm. The resin particles of the developer having the hydroxycarboxylic acid dispersed therein may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The negative liquid electrostatic developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed at least one of thermoplastic resin, hydroxycarboxylic acid, and dispersant nonpolar liquid described above. Generally the resin, hydroxycarboxylic acid, dispersant nonpolar liquid, and optional colorant are placed in the vessel prior to starting the dispersing step. Optionally the colorant can be added after homogenizing the resin and the dispersant nonpolar liquid. Polar additive can also be present in the vessel, e.g., up to 100% based on the weight of polar additive and dispersant nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart a negative electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 10 percent by weight, preferably 0.3 to 3.0, and more preferably 0.5 to 2 weight percent with respect to the dispersant nonpolar liquid. One or more nonpolar liquid soluble ionic or zwitterionic charge director compounds (C), of the type set out above, can be added to impart a negative charge. The addition may occur at any time during the process; preferably at the end of the process, e.g., after the particulate media, if used, are removed and the concentration of toner particles is accomplished. If a diluting dispersant nonpolar liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged. Preferably the adjuvant compound is added after the dispersing step. It has been found that when the adjuvant is a polyhydroxy compound it is added after process step (B) or (C).

Other process embodiments for preparing the liquid electrostatic developer include:

(A) dispersing a hydroxycarboxylic acid as defined above in a thermoplastic resin in the absence of a dispersant nonpolar liquid having a Kauri-butanol value of less than 30 to form a solid mass.

(B) shredding the solid mass, (C) grinding the shredded solid mass by means of particulate media in the presence of a liquid taken from the group consisting of a polar liquid having a Kauri-butanol value of at least 30, a nonpolar liquid having a Kauri-butanol value of less than 30, and combinations thereof, thereby forming a dispersion of toner particles.

(D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid; and (F) adding to the dispersion a liquid soluble ionic or zwitterionic charge director compound which imparts a negative charge to the thermoplastic toner particles; and (A) dispersing a hydroxycarboxylic acid as defined above in a thermoplastic resin in the absence of a dispersant nonpolar liquid having a Kauri-butanol value of less than 30 to form a solid mass.

(B) shredding the solid mass, (C) redispersing the shredded solid mass at an elevated temperature in a vessel in the presence of a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (D) cooling the dispersion, and forming a dispersion of toner particles, either (1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic charge director compound which imparts a negative charge to the thermoplastic toner particles.

A preferred mode of the invention is described in Example 1.

INDUSTRIAL APPLICABILITY

The electrostatic liquid developers of this invention demonstrate improved image quality, resolution, solid area coverage (density), and toning of fine details, evenness of toning, and reduced squash independent of charge director and pigment present. The particles are exclusively charged negative. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image and can be transferred, if desired. Other uses are envisioned for the liquid electrostatic developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A; the average particle sizes by area were determined by a Horiba CAPA-500 centrifugal particle analyzer as described above and are in the range of 0.5 to 2.5 μm, the conductivity was measured in picomhos (pmho)/cm at 5 hertz and low voltage, 5 volts, the density was measured using a Macbeth densitometer model RD918 transfer efficiency is determined as follows: a toned electrostatic image is transferred from the photoreceptor in the copier to a paper carrier sheet. A transparent adhesive tape is applied over the residual toned electrostatic image on the photoreceptor and the residual image is removed with the tape and placed on the previously image carrier sheet adjacent to (but not contacting) the transferred image. The density of both images is measured with a densitometer as previously described. The transfer efficiency is the percentage value obtained by dividing the density of the transferred image by the sum of the densities of the transferred and residual images. The resolution is expressed in the Examples in line pairs/mm (1 p/mm).

CONTROL 1

In a Union Process 1S Attritor, Union Process Company, Akron, Ohio, were placed the following ingredients:

| Ingredient | Amount (g) |
|---|---|
| Copolymer of ethylene (89%) and methacrylic acid (11%) melt index at 190° C. is 100, Acid No. is 66. | 200.0 |
| Heucophthal Blue G XBT-583D Heubach. Inc., Newark, NJ | 13.86 |
| Dalamar ® Yellow YT-858D Heubach, Inc., Newark, NJ | 0.14 |
| Isopar ®-L nonpolar liquid having a Kauri-butanol value of 27, Exxon Corporation | 1000.0 |

The ingredients were heated to 90° C. to 110° C. and milled at a rotor speed of 230 rpm with 0.1875 inch (4.76 mm) diameter stainless steel balls for two hours. The attritor was cooled to 42° C. to 50° C. while the milling was continued, and then 700 grams of Isopar ®-H, nonpolar liquid having a Kauri-butanol value of 27, Exxon Corporation, were added. Milling was continued and the average particle size was monitored. The particulate media were removed and the dispersion of toner particles was then diluted to 1% solids with additional Isopar ®-H and a charge director, Basic Barium Petronate ®, was added (141 mg Basic Barium Petronate ®/g of toner solids). Image quality was determined using a Savin 870 copier in a standard mode: charging corona set at 6.8 kV and transfer corona set at 8.0 kV using carrier sheets such as Plainwell offset enamel paper number 3 class 60 lb test and Savin 2200+ paper, designated S-2200+ in Table 1 below. Image quality was found to be very poor with low resolution, uneven toning, uneven solids, high squash, and high trailing edge smear. Results are found in Table 1 below.

CONTROL 2

The procedure described in Control 1 was repeated with the following exceptions: the toner was charged with Oloa ®, Chevron Corp., at 600 mg of Oloa ® 1200 per gram of toner solids instead of the Basic Barium Petronate ®. Image quality was very poor with low resolution, high squash, low transfer efficiency, poor solid areas, and high background toning. Results are shown in Table 1 below.

CONTROL 3

In a Union Process 01 Attritor, Union Process Company, Akron, Ohio, was placed the following ingredients:

| Ingredient | Amount (g) |
|---|---|
| Copolymer of ethylene (89%) and methacrylic acid (11%) melt index at 190° C. is 100, Acid No. is 66. | 35.0 |
| Isopar ®-L described in Control 1 | 125.0 |

The ingredients were heated to 90° C. to 110° C. and milled at a rotor speed of 230 rpm with 0.1875 inch (4.76 mm) diameter stainless steel balls for 2 hours. The attritor was cooled to 42° C. to 50° C. while milling was continued and then 88 grams of Isopar®-H described in Control 1 were added. Milling was continued and the average particle size was monitored. The particulate media were removed and the dispersion of toner particles was then diluted to 2% solids with additional Isopar®-L and a charge director, Basic Barium Petronate®, was added (90 mg Basic Barium Petronate®/g of toner solids). Image quality was determined as described in Control 1. Image quality was found to be poor with low resolution, uneven copy, no toning of fine details, and low transfer efficiency. Results are found in Table 1 below. Due to lack of pigments, transfer efficiencies were estimated by eye.

CONTROL 4

The procedure described in Control 1 was followed with the following exceptions: instead of the Heucophthal blue and Dalamar® Yellow, 24.7 grams of magenta pigment RV-6803 (Mobay) and 10.6 grams of Scarlet pigment R-6300 (Mobay) were used. The dispersion of toner was diluted to 2% solids and charged to a bulk conductivity of 54 pmho/cm with 44.44 grams of Basic Barium Petronate® (108 mg/g of toner solids). Image quality was found to be good with good resolution and transfer efficiency but the image exhibited severe squash and solid area microvoids. Results are found in Table 1 below.

CONTROL 5

The procedure described in Control 3 was followed with the following exceptions: in addition to the above, 2.63 grams of Heucophthal Blue G XBT-583D was added. The dispersion of toner was diluted to 2% solids and charged with 32.70 grams of Basic Barium Petronate® (90 mg/g of toner solids). Image quality was found to be poor with severe squash and solid area microvoids. Results are found in Table 1 below.

CONTROL 6

The procedure described in Control 1 was followed with the following exceptions: the dispersion of toner was diluted to 2% solids and charged with 31.6 grams of 10% Basic Barium Petronate® (90 mg/g of toner solids). Image quality was found to be poor with uneven copy, low resolution, uneven solids, poor toning of fine details, and high image squash. Results are found in Table 1 below.

CONTROL 7

The procedure described in Control 1 was followed with the following exceptions: instead of the above ingredients the following ingredient was added: 14 grams Heucophthal Blue G XBT-583D. The dispersion of toner was diluted to 2% solids and charged with 12.4 grams of 10% Lecithin (31 mg/g of toner solids). Image quality was found to be poor with uneven copy, low resolution, uneven solids, poor toning of fine details, and image squash. Results are found in Table 1 below.

CONTROL 8

The procedure described in Control 3 was followed with the following exceptions: in addition to the above ingredients the following ingredients were also added: 2.45 grams Heucophthal Blue G XBT-583D (Heubach, Inc.) and 0.37 grams 16-hydroxyhexadecanoic acid (Fairfield Chemical Co., Blythewood, SC). Toner was charged with 10.14 grams of 10% Lecithin (31 mg/g of toner solids) as described in Control 5. Image quality was found to be the same as described in Control 5. Results are found in Table 1 below.

CONTROL 9

The procedure described in Control 3 was followed with the following exceptions: in addition to the above ingredients the following ingredients were also added: 2.68 grams Heucophthal Blue G XBT-583D (Heubach, Inc.), 0.03 grams Dalamar® Yellow YT-858D (Heubach, Inc.), and 0.77 gram 10-hydroxydecanoic acid (Sigma Chemical Co., St. Louis, MO). Toner was charged with 32.29 grams of 10% Basic Barium Petronate® (90 mg/g) of toner solids as described in Control 7. Image quality was found to be poorer than Control 7 with poorer resolution, transfer efficiency, evenness of copy, and solid areas. Results are found in Table 1 below.

EXAMPLE 1

The procedure described in Control 3 was followed with the following exceptions: in addition to the ingredients of Control 3 the following ingredients were also added: 2.66 grams Heucophthal Blue G XBT-583D (Heubach, Inc.), 0.03 gram Delamar® Yellow YT-858D (Heubach, Inc.), and 0.77 gram 16-hydroxyhexadecanoic acid (Aldrich Chemical Co.). The dispersion of toner was diluted to 1% solids and split into 2 portions. One portion was charged as in Control 1 with 25.59 grams of Basic Barium Petronate® (141 mg/g of toner solids). Image quality was found to be improved compared to Control 1 with improved transfer efficiency, higher resolution, more even copy, and more even solid areas. Results are found in Table 1 below.

EXAMPLE 2

The procedure described in Example 1 was repeated with the following exceptions: the second portion was charged, identically to Control 2, with Oloa®1200 (Chevron) (600 mg of Oloa®1200/g of toner solids) instead of the Basic Barium Petronate®. Image quality was found to be improved compared to Control 2 with higher transfer efficiency, higher resolution, and no background toning. Results are found in Table 1 below.

EXAMPLE 3

The procedure described in Control 3 was repeated with the following exceptions: in addition to the ingredients of Control 3, 0.71 gram of 16-hydroxyhexadecanoic acid (Aldrich Chemical Co.) was added. The dispersion of toner was diluted to 2% and charged with 30.81 grams of Basic Barium Petronate® (90 mg/g of toner solids). Image quality was found to be improved compared to Control 3 with higher resolution, improved transfer efficiency, more even copy, more toning of fine details, and a denser image and solid areas. Results are found in Table 1 below. Due to lack of pigments, transfer efficiencies were estimated by eye.

EXAMPLE 4

The procedure described in Control 3 was followed with the following exceptions: in addition to the above ingredients, 4.43 grams of Magenta pigment RV-6803 (Mobay), 1.90 grams of Scarlet pigment R-6300 (Mobay), and 0.84 grams of 16-hydroxystearic acid (Aldrich Chemical Co.) were added. Toner was charged to the same bulk conductivity (55 pmho/cm) as 9. A negative, liquid electrostatic developer according to claim 1 wherein an additional compound is present which is an adjuvant taken from the group consisting of polyhydroxy compound, aminoalcohol, polybutylene succinimide, metallic soap, inorganic metal salt, and an aromatic hydrocarbon.

10. A negative, liquid electrostatic developer according to claim 5 wherein an additional compound is present which is an adjuvant taken from the group consisting of polyhydroxy compound, aminoalcohol, polybutylene succinimide, metallic soap, inorganic metal salt and an aromatic hydrocarbon.

11. A negative, liquid electrostatic developer according to claim 9 wherein a polyhydroxy adjuvant compound is present.

12. A negative, liquid electrostatic developer according to claim 9 wherein an aminoalcohol adjuvant compound is present.

13. A negative, liquid electrostatic developer according to claim 9 wherein a polybutylene succinimide adjuvant compound is present.

14. A negative, liquid electrostatic developer according to claim 9 wherein a metallic soap adjuvant compound is present.

15. A negative, liquid electrostatic developer according to claim 9 wherein an inorganic metal salt adjuvant compound is present.

16. A negative, liquid electrostatic developer according to claim 9 wherein an aromatic hydrocarbon adjuvant compound is present.

17. A negative, liquid electrostatic developer according to claim 12 wherein the aminoalcohol adjuvant compound is triisopropanolamine.

18. A negative, liquid electrostatic developer according to claim 1 wherein the thermoplastic resin is a copolymer of ethylene and an $\alpha,\beta$-ethylenically unsaturated acid selected from the group consisting of acrylic acid and methacrylic acid.

19. A negative, liquid electrostatic developer according to claim 1 wherein the thermoplastic resin is polystyrene.

20. A negative, liquid electrostatic developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

21. A negative, liquid electrostatic developer according to claim 5 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

22. A negative, liquid electrostatic developer according to claim 20 wherein the thermoplastic resin is a copolymer of ethylene (89%)/methacrylic acid (11%) having a melt index at 190° C. of 100.

23. A negative, liquid electrostatic developer according to claim 1 wherein the particles have an average by area particle size of less than 5 $\mu$m.

24. A negative, liquid electrostatic toner according to claim 1 wherein component (C) is oil-soluble petroleum sulfonate.

25. A process for preparing negative, liquid electrostatic developer for electrostatic imaging comprising (A) dispersing at an elevated temperature in a vessel a thermoplastic resin, a hydroxycarboxylic acid of the formula: HO—X—COOH wherein X is a divalent saturated or unsaturated aliphatic hydrocarbon containing at least 12 carbon atoms or aromatic hydrocarbon containing at least 6 carbon atoms, and in which there are at least 4 carbon atoms between the hydroxy and carboxylic acid groups, a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid;

(C) separating the dispersion of thermoplastic resin particles having an average by area particle size of less than 10 $\mu$m from the particulate media, and (D) adding to the dispersion a nonpolar liquid soluble ionic or zwitterionic compound which imparts a negative charge to the thermoplastic toner particles.

26. A process according to claim 25 wherein X in the hydroxycarboxylic acid of the formula HO—X—COOH is a saturated or unsaturated aliphatic hydrocarbon containing at least 12 carbon atoms.

27. A process according to to claim 25 wherein X in the hydroxycarboxylic acid of the formula HO—X—COOH is an aromatic hydrocarbon containing at least 6 carbon atoms.

28. A negative liquid electrostatic developer according to claim 25 wherein the hydroxycarboxylic acid is 16-hydroxyhexadecanoic acid.

29. A process according to claim 25 wherein there is present in the vessel up to 100% by weight of a polar additive having a Kauri-butanol value of at least 30, the percentage based on the total weight of the liquid in the developer.

30. A process according to claim 25 wherein the particulate media are taken from the group consisting of stainless steel, carbon steel, ceramic, alumina, zirconium, silica and sillimanite.

31. A process according to claim 25 wherein the thermoplastic resin is a copolymer of ethylene and an $\alpha,\beta$-ethylenically unsaturated acid selected from the group consisting of acrylic acid and methacrylic acid.

32. A process according to claim 25 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

33. A process according to claim 32 wherein the thermoplastic resin is a copolymer of ethylene (89%) methacrylic acid (11%) having a melt index at 190°0 C. of 100.

34. A process according to claim 25 wherein the ionic or zwitterionic compound is oil-soluble petroleum sulfonate.

35. A process according to claim 25 wherein the additional dispersant nonpolar liquid polar liquid or Control 4 with 47.65 grams of Bulk Barium Petronate® (119 mg/g of toner solids) Image quality was found to be improved compared to Control 4 with improved solid areas (lack of microvoids), and sharper copy quality. Resolution was the same at a higher density showing improvement. Results are found in Table 1 below.

EXAMPLE 5

The procedure described in Control 5 was followed with the following exceptions: the following ingredient changes were made: 2.69 grams Heucophthal Blue G XBT-583D (Heubach, Inc.) was used instead of 2.63 grams and 0.77 gram 16-hydroxybenzoic acid (Aldrich Chemical Co.) was added. Image quality was found to be improved compared to Control 5 with improved solid areas with fewer microvoids, slightly improved transfer efficiency, and the same resolution at higher density. Results are found in Table 1 below.

EXAMPLE 6

The procedure described in Control 3 was followed with the following exceptions: in addition to the above ingredients the following ingredients were also added: 2.68 grams Heucophthal Blue G XBT-583D (Heubach, Inc.), 0.03 gram Dalamar® Yellow YT-858D (Heubach, Inc.), and 0.77 gram 12-hydroxydodecanoic acid (Sigma Chemical Co.). Toner was charged with 33.95 gram of 10% Basic Barium Pertronate® (90 mg/g of toner solids as described in Control 6. Image quality was found to be improved compared to Control 6 with improved resolution, transfer efficiency, and solid areas. Results are found in Table 1 below.

EXAMPLE 7

The procedure described in Control 3 was followed with the following exceptions: in addition to the above ingredients the following ingredients were also added: 2.68 grams Heucophthal Blue G XBT-583D (Heubach, Inc.), 0.03 gram Dalamar® Yellow YT-858D (Heubach, Inc.), and 0.77 gram 15-hydroxypentadecanoic acid (Fairfield Chemical Co.). Toner was charged with 33.12 grams of 10% Basic Barium Petronate® (90 mg/g of toner solids) as described in Control 6. Image quality was found to be improved compared to Control 6 with improved resolution, transfer efficiency, and solid areas. Results are found in Table 1 below.

TABLE 1

| Ex. or Cont. (c) | Charge Director ( )* | Cond. Bulk (pmho/cm) | Resolution (l p/mm) | Solid Area | Trans. Eff. Enamel | Trans. Eff. S-2200+ |
|---|---|---|---|---|---|---|
| C1 | Ba Pet. ® (141) | 55 | 7–8 | V. poor | 97% | 92% |
| C2 | Oloa ® (600) | 45 | 6–7 | Poor | 78% | 63% |
| C3 | Ba. Pet. ® (90) | 73 | 6–7 | Average | ~90% | ~80% |
| C4 | Ba. Pet. ® (108) | 54 | 10–11 | Average | 98% | 88% |
| C5 | Ba. Pet. ® (90) | 102 | 9–10 | V. poor | 95% | 92% |
| C6 | Ba. Pet. ® (90) | 62 | 9 | V. poor | 89% | 61% |
| C7 | Lecithin (31) | 61 | 4–6 | V. poor | 98% | 92% |
| C8 | Lecithin (31) | 71 | 3–5 | V. poor | 95% | 79% |
| C9 | Ba. Pet. ® (90) | 44 | 6–7 | V. poor | 66% | 22% |
| 1 | Ba. Pet. ® (141) | 55 | 9–10 | Average | 99% | 98% |
| 2 | Oloa ® (600) | 88 | 7–8 | Poor | 92% | 80% |
| 3 | Ba. Pet. ® (90) | 60 | 8–9 | Good | ~95% | ~85% |
| 4 | Ba. Pet. ® (119) | 55 | 10–11 | V. good | 98% | 96% |
| 5 | Ba. Pet. ® (90) | 77 | 9–10 | Good | 98% | 96% |
| 6 | Ba. Pet. ® (90) | 53 | 10 | Good | 96% | 90% |
| 7 | Ba. Pet. ® (90) | 62 | 10–11 | Good | 99% | 96% |

*(mg/g of charge director per toner solids)

What is claimed is:

1. A negative, liquid electrostatic developer having improved charging characteristics consisting essentially of (A) a nonpolar liquid having a Kauri-butanol value of less than 30, present in 85 to 99.9% by weight, based on the total weight of liquid developer, (B) thermoplastic resin particles having dispersed therein 0.1 to 10% by weight based on the total weight of developer solids of a hydroxycarboxylic acid of the formula: HO—X—COOH wherein X is a divalent saturated or unsaturated aliphatic hydrocarbon containing at least 12 carbon atoms or aromatic hydrocarbon containing at least 6 carbon atoms, and in which there are at least 4 carbon atoms between the hydroxy and carboxylic acid groups, the resin particles having an average by area particle size of less than 10 μm, and (C) a nonpolar liquid soluble ionic or zwitterionic charge director compound which imparts a negative charge to the thermoplastic resin particles present in an amount of 1 to 1000 μm/g developer solids, the total weight of developer solids is 0.1 to 15% by weight.

2. A negative liquid electrostatic developer according to claim 1 wherein X in the hydroxycarboxylic acid of the formula HO—X—COOH is a saturated or unsaturated aliphatic hydrocarbon containing at least 12 carbon atoms.

3. A negative liquid electrostatic developer according to claim 2 wherein X in the hydroxycarboxylic acid of the formula HO—X—COOH is an aromatic hydrocarbon containing at least 6 carbon atoms.

4. A negative liquid electrostatic developer according to claim 1 wherein the hydroxycarboxylic acid is 16-hydroxyhexadecanoic acid.

5. A negative, liquid electrostatic developer according to claim 1 containing up to about 60 percent by weight of a colorant based on the total weight of developer solids.

6. A negative, liquid electrostatic developer according to claim 5 wherein the colorant is a pigment.

7. A negative, liquid electrostatic developer according to claim 5 wherein the colorant is a dye.

8. A negative, liquid electrostatic developer according to claim 1 wherein a fine particle size oxide is present.

combinations thereof is present to reduce the concentration of toner particles to between 0.1 to 15 percent by weight with respect to the liquid.

36. A process according to claim 35 wherein the concentration of toner particles is reduced by additional dispersant nonpolar liquid.

37. A process according to claim 25 wherein cooling the dispersion is accomplished while grinding by means of particulate media to prevent the formation of a gel or solid mass in the presence of additional liquid.

38. A process according to claim 25 wherein cooling the dispersion is accomplished without stirring to form a gel or solid mass, followed by shredding the gel or solid mass and grinding by means of particulate media in the presence of additional liquid.

39. A process according to claim 25 wherein cooling the dispersion is accomplished with stirring to form a viscous mixture and grinding by means of particulate media in the presence of additional liquid.

40. A process according to claim 25 wherein an adjuvant compound taken from the group consisting of polyhydroxy compound, aminoalcohol, polybutylene succinimide, metallic soap, inorganic metal salt, and an aromatic hydrocarbon is added during the dispersing step (A).

41. A process according to claim 40 wherein the adjuvant compound is an aminoalcohol.

42. A process according to claim 41 wherein the aminoalcohol is triisopropanolamine.

43. A process according to claim 35 wherein an adjuvant compound taken from the group consisting of polyhydroxy compound, aminoalcohol, polybutylene succinimide, metallic soap, inorganic metal salt, and an aromatic hydrocarbon is added to the liquid developer.

44. A process according to claim 43 wherein the adjuvant compound is a polyhydroxy compound.

45. A process according to claim 44 wherein the polyhydroxy compound is ethylene glycol.

46. A process according to claim 43 wherein the adjuvant compound is a metallic soap.

47. A process according to claim 46 wherein the metallic soap is aluminum tristearate.

48. A process according to claim 46 wherein the adjuvant compound is an inorganic metal salt.

* * * * *